United States Patent [19]

Doehler et al.

[11] 4,185,225

[45] Jan. 22, 1980

[54] TRAVELING WAVE TUBE

[75] Inventors: Oskar F. Doehler, Glen Ellyn; Robert J. Espinosa, McHenry; Gary G. Groshart, Des Plaines, all of Ill.

[73] Assignee: Northrop Corporation, Rolling Meadows, Ill.

[21] Appl. No.: 891,696

[22] Filed: Mar. 24, 1978

[51] Int. Cl.[2] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 2,611,101 | 9/1952 | Wallauschek | 315/3.6 |
| 2,889,487 | 6/1959 | Birdsall et al. | 315/3.6 |
| 2,941,112 | 6/1960 | Webber | 315/3.5 |
| 3,200,286 | 8/1965 | Rorden | 315/3.5 |
| 3,519,964 | 7/1970 | Chorney et al. | 315/3.5 X |
| 3,551,729 | 12/1970 | Bradford | 315/3.5 |
| 3,670,196 | 6/1972 | Smith | 315/3.5 |

*Primary Examiner*—Saxfield Chatmon, Jr,
*Attorney, Agent, or Firm*—Wegner, Stellman, McCord, Wiles & Wood

[57] ABSTRACT

A traveling wave tube having a helix continuously supported within a dielectric barrel provides efficient operation at high power levels. The wire forming the helix has a greater width along its inner surface adjacent the interaction space of the traveling wave tube than along its outer surface which is continuously secured to the dielectric barrel. The wire confines the electromagnetic field to an area adjacent the interaction space for low dielectric loading thereby assuring a good coupling impedance into and out of the traveling wave tube and a wide bandwidth. Improved thermal conductivity for heat from the helix is provided as a result of the helix being continuously supported and in contact with the dielectric barrel. The tube is low in cost, which makes it attractive for expendable use.

7 Claims, 9 Drawing Figures

TRAVELING WAVE TUBE

BACKGROUND OF THE INVENTION

This invention relates to an efficient low cost traveling wave tube having a high power capability.

Traveling wave tubes are used to amplify signals in microwave systems including electronic countermeasure systems. Some applications require that the traveling wave tube be expendable. Accordingly, it is desirable to provide a reliable low cost traveling wave tube that is capable of efficiently amplifying microwave signals over a wide bandwidth and at a reasonably high power level.

Efficient traveling wave tubes having a wide bandwidth and high power capability are known to the prior art. These tubes are of complex construction and expensive since they must adequately dissipate heat during high power operation and at the same time provide a high coupling impedance into and out of the tube. These tubes usually include a helix formed from a wire having a square or rectangular cross section disposed within a vacuum formed within a metal barrel heat sink. The helix is supported by three or more dielectric rods equally spaced about the helix and in contact with both the helix and the metal barrel heat sink. The helix is secured to the rods at each point where the helix comes into contact therewith to establish a thermal conductive path from the helix to the metal barrel heat sink for heat dissipation. The power capacity of these tubes is limited by the capability of the structure to dissipate heat through the limited point contacts between the helix and the support rods.

Increasing the width of the dielectric rods to provide greater surface area for heat transfer from the helix to the dielectric rod has not provided an acceptable solution because the wider rods increase the dielectric loading which decreases the coupling impedance into and out of the tube, thereby decreasing both gain and bandwidth.

The traveling wave tubes known to the prior art are of a configuration that provides for sufficient heat conduction through the dielectric supports while maintaining a relatively low dielectric loading. To accomplish this, expensive and complex tube configurations are required.

SUMMARY OF THE INVENTION

In accordance with the present invention, a simply constructed, low cost traveling wave tube having a low dielectric loading, a wide bandwidth and high power capability is realized by employing a helix of a novel cross-sectional configuration and a dielectric barrel in place of the dielectric support rods known to the prior art. The helix is formed by a wire having a greater width along its inner surface, adjacent the interaction space of the traveling wave tube, than along its outer surface, which is continuously secured to the dielectric tube. The wire confines the electromagnetic field to an area adjacent the interaction space for providing low dielectric loading, and the continuous connection between the outer surface of the helix and the dielectric barrel provides for an improved conductive path to dissipate heat and allow increased power capability of the traveling wave tube.

DRAWING

DETAILED DESCRIPTION OF PREFERRED EMBODIMENT

Figure 1:
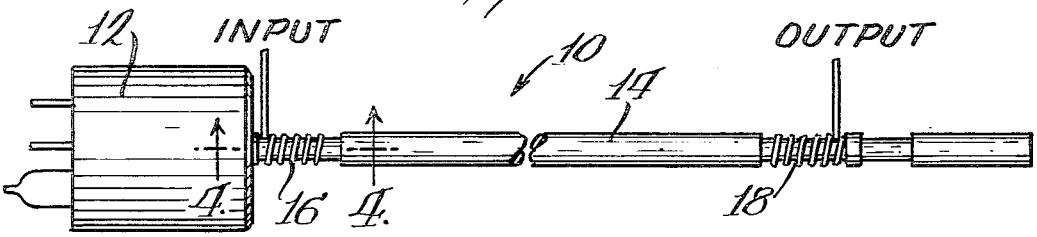
FIG. 1 is an elevational view of an amplifier employing a traveling wave tube of the present invention.

Referring to FIG. 1, a traveling wave tube amplifier system 10 includes an electron gun 12 coupled to a traveling wave tube 14. A signal to be amplified is applied to input coupling helix 16 in a suitable manner. Amplification of the signal takes place within traveling wave tube 14 substantially along its entire length. The amplified signal is removed from an output coupling helix 18.

Figure 2:
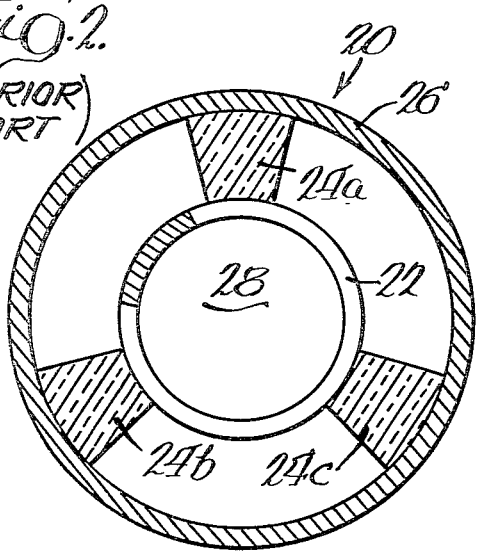
Fig. 2. (PRIOR ART)
FIG. 2 is a cross-sectional view of a low power traveling wave tube known to the prior art.

The advantages of the improved traveling wave tube 14 of the present invention can best be realized by first considering traveling wave tubes known to the prior art. Referring to FIG. 2, a traveling wave tube 20 includes a helix 22 formed of a wire having a rectangular cross section supported by three dielectric rods 24*a*, 24*b* and 24*c* which are equally spaced about helix 22. The dielectric rods 24*a*, 24*b* and 24*c* are secured to metal barrel heat sink 26. An electron beam (not shown) propagated through interaction space 28 generates heat along helix 22. The heat flows from helix 22 through dielectric rods 24*a*, 24*b* and 24*c*, and is dissipated by barrel heat sink 26.

The width of the rods 24 determines the dielectric loading of the traveling wave tube. The thinner the rods 24, the less the dielectric loading, thereby advantageously providing a higher coupling impedance between the interaction space 28 and the outside of the traveling wave tube and a wider bandwidth. However, the thinner the rods 24, the less capable they are of providing heat transfer from helix 22 to metal barrel heat sink 26, thereby limiting the power capability of the tube.

Figure 3:
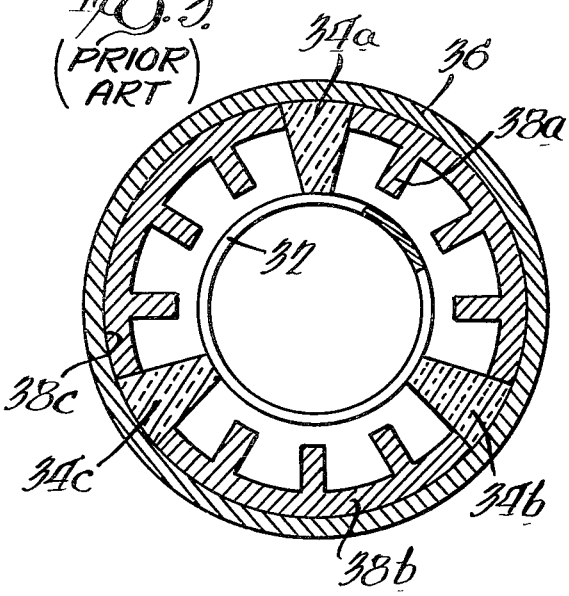
Fig. 3. (PRIOR ART)
FIG. 3 is a cross-sectional view of a high power traveling wave tube known to the prior art.
Figure 4:
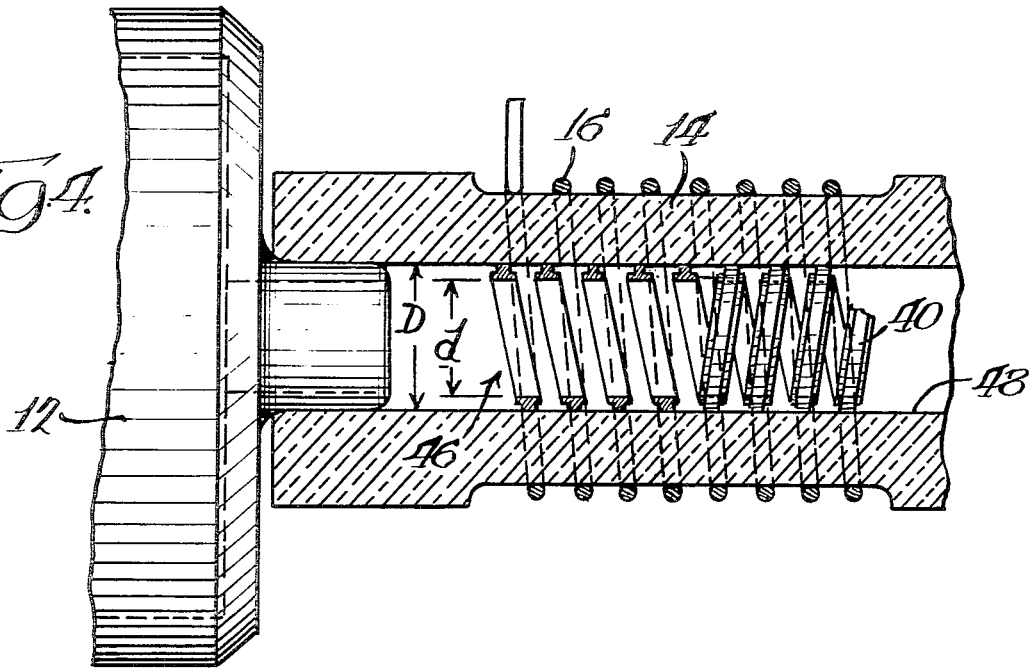
FIG. 4 is a fragmentary longitudinal cross-sectional view of the traveling wave tube taken along line 4—4 in FIG. 1.

Referring to FIG. 3, a traveling wave tube having higher power capability is shown. The traveling wave tube 30 has a helix 32 formed of wire having a rectangular cross section and supported by dielectric rods 34*a*, 34*b* and 34*c*. The rods 34 are secured to the metal barrel heat sink 36, as are the radially projecting conducting fins or vanes 38*a*, 38*b* and 38*c* that extend along the axis of the tube for anisotropic heat dissipation. The vanes 38 increase the power capability of traveling wave tube 30. The thickness of rods 34 may be less than the thickness of the rods in FIG. 1 to minimize dielectric loading.

The metal barrel heat sink 36 and the vanes 38 are expensive. Also, feed-throughs, such as wave guides, are required to couple a signal to be amplified through the metal barrel heat sink 36. As such, the tubes are not suitable for expendable use.

Figure 5:
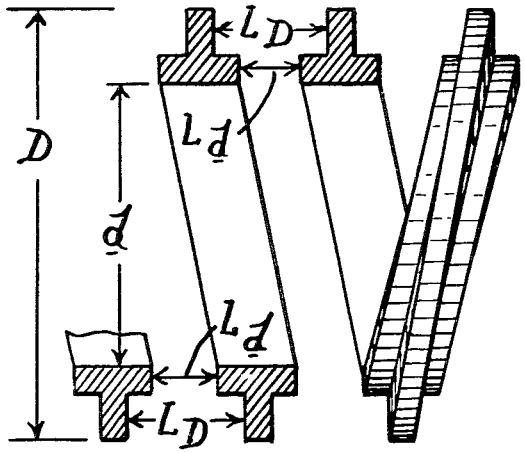
FIG. 5 is an enlarged cross-sectional view of the wire forming the helix shown in FIG. 4.

Referring to FIG. 5, the traveling wave tube 14 of the present invention includes a helix 40, formed by wire 42, which extends within dielectric barrel 44 from the input coupling helix 16 to the output coupling helix 18 (FIG. 1). The inner diameter d of the helix 40 defines an interaction space 46 through which an electron beam from electron gun 12 is propagated. The outer diameter D of the wire 42 defines the outer surface of the helix 40. The outer surface of the helix 40 is secured to the dielectric barrel 44 along its entire length by any acceptable technique such as cementing, brazing or heat shrinking of the barrel. The dielectric material forming the barrel 44 may be constructed from a solid cylindrical piece of $Al_2O_3$, glass or any other suitable material having a center bore 48.

As best seen in FIG. 5, the width of wire 42 forming body 40 and having a T-shaped cross section is greater at the inner diameter d than at the outer diameter D. Thus, the distacne $L_d$ between the turns of wire 42 at the inner surface d is less than the distance $L_D$ between the wire at the outer surface D.

This particular configuration causes the electromagnetic energy generated by the electron beam to be concentrated more closely to the interaction space 46 resulting in only a small amount of electromagnetic energy being stored or contained within the dielectric barrel 44. Accordingly, the dielectric loading factor is small and, as a result, amplifier system 10 has a high input and output coupling impedance which is a factor in achieving high efficiency. Moreover, since the helix 40 is secured to the dielectric barrel 44 along its entire length, increased thermal conductivity from the helix to the dielectric material is realized when compared to the use of the dielectric rods as shown in FIGS. 2 or 3, resulting in high power capability. In fact, the power handling capability of the tube 14 is at least two to three times greater than the tube shown in FIG. 3 if the material for the dielectric rods (in FIG. 3) is selected to be the same as the dielectric barrel 44.

Figure 6:
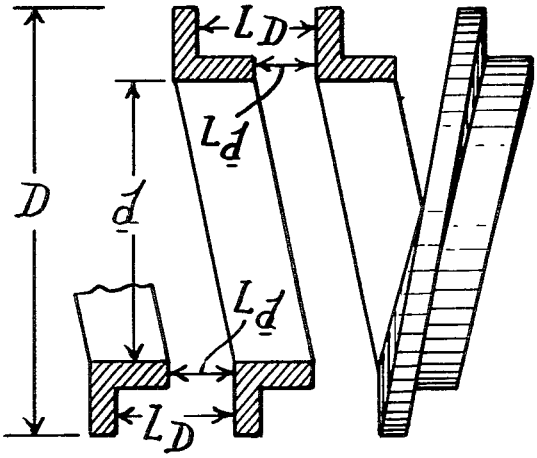
FIG. 6 and FIG. 7 are enlarged cross-sectional views of wires of other configurations that may be used to form the helix in accordance with the present invention.
Figure 7:
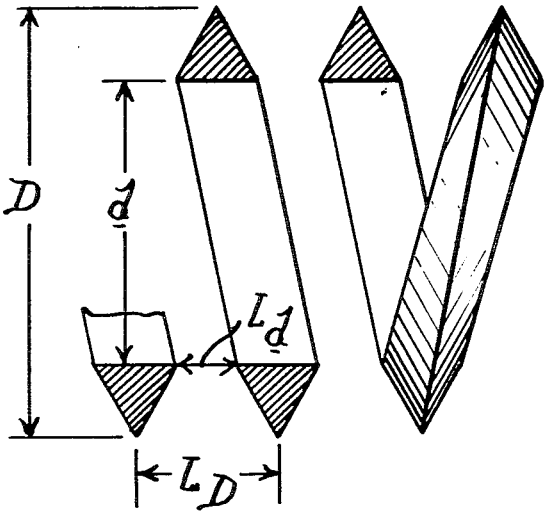

Referring to FIG. 6 and FIG. 7, it is apparent that there are many shapes of wire that satisfy the requirements discussed above. For example, the helix 40 can be formed of a wire 50 having an L-shaped cross section as in FIG. 6. The distance $L_d$ between the turns of wire 50 is smaller at d than the distance $L_D$ between the turns of wire 50 at D.

Also, as seen in FIG. 7, helix 40 can be formed of a wire 52 having a triangular cross section that satisfies the width requirement discussed above.

Figure 8:
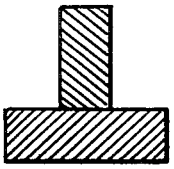
FIG. 8 and FIG. 9 are enlarged cross-sectional views of wires (fabricated by bonding together individual wires) that may be used to form the helix in accordance with the present invention.
Figure 9:
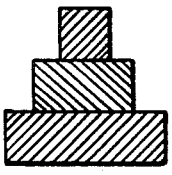

Alternatively, the desired cross-sectional configuration of the wire may be achieved by bonding two or three rectangular wires together, as shown in FIGS. 8 and 9.

The wire forming the helices of the present invention, as discussed above, may be made from copper, copper alloys, niobium, tungsten, or any other suitable material. Also, it is apparent that further heat dissipation may be realized by surrounding the dielectric barrel 44 between the coupling helices 16 and 18 with a metallic barrel for improved heat conduction.

We claim:

1. A traveling wave tube having a wide bandwidth, high efficiency and high power capability comprising:

a single helix defining an interaction space formed by an inner diameter of the helix and an outer surface defined by an outer diameter of the helix, said helix formed by a metal element wherein the width of said element is greater at the inner diameter than at the outer diameter; and a dielectric barrel having a center bore receiving said metal helix wherein said outer surface of said helix is secured to said dielectric barrel.

2. A traveling wave tube comprising:

a dielectric barrel having a center bore therethrough;

a plurality of turns of a metal element forming a unifilar helix having low capacitance between turns wherein said helix is disposed within said center bore and the metal element has an inner diameter defining an interaction space and an outer diameter defining an outer surface wherein said outer surface is attached to said dielectric member and the distance at the outer surface between two adjacent turns of the metal element forming the helix is more than the distance at the inner surface between two adjacent turns of the metal elemen forming the helix.

3. The traveling wave tube of either claim 1 or claim 2 wherein said metal element forming the single helix has a T-shaped cross-sectional configuration.

4. The traveling wave tube of either claim 1 or claim 2 wherein said metal element forming the angle helix has an L-shaped cross-sectional configuration.

5. The traveling wave tube of either claim 1 or claim 2 wherein said metal element forming the single helix has a triangular cross-sectional configuration.

6. The traveling wave tube of claim 3 wherein said metal element forming the single helix having a T-shaped cross-sectional configuration is formed of two metal elements bonded together, each having a rectangular cross-sectional configuration.

7. The traveling wave tube of claim 3 wherein said metal element forming the single helix having a T-shaped cross-sectional configuration is formed of three metal elements bonded together, each having a rectangular cross-sectional configuration.

* * * * *